US006085664A

United States Patent [19]

Early

[11] Patent Number: 6,085,664

[45] Date of Patent: Jul. 11, 2000

[54] VENTED HATCH COVER

[75] Inventor: Stephen R. Early, Olathe, Kans.

[73] Assignee: Aero Transportation Products, Inc., Independence, Mo.

[21] Appl. No.: 08/933,682

[22] Filed: Sep. 19, 1997

[51] Int. Cl.[7] ..... B61D 39/00; B65D 51/16

[52] U.S. Cl. ..... 105/377.07; 220/374; 220/367.1; 220/259; 220/373; 220/745; 220/747

[58] Field of Search ..... 220/373, 371, 220/374, 745, 747, 255, 256, 259, 202, 367.1, 659, 366.1; 215/310, 307, 308; 105/377.07

[56] References Cited

U.S. PATENT DOCUMENTS

| | | | |
|---|---|---|---|
| 494,157 | 3/1893 | Newell | 215/308 X |
| 3,428,236 | 2/1969 | Bidwell | 220/367.1 X |
| 3,741,427 | 6/1973 | Doyle | 220/374 X |
| 4,081,107 | 3/1978 | Martin, Jr. et al. | 220/374 |
| 4,094,437 | 6/1978 | Hayashida | 220/374 |
| 4,127,216 | 11/1978 | Martin, Jr. et al. . | |
| 4,181,238 | 1/1980 | Arnold et al. . | |
| 4,495,731 | 1/1985 | Sears . | |
| 4,501,377 | 2/1985 | Palmer, III | 105/377.07 X |
| 4,609,126 | 9/1986 | Janda . | |
| 4,655,365 | 4/1987 | Miller . | |
| 4,819,830 | 4/1989 | Schultz . | |
| 4,934,545 | 6/1990 | Pezzoli et al. | 215/308 X |
| 5,064,089 | 11/1991 | Schultz | 220/374 X |
| 5,152,419 | 10/1992 | Yangi | 220/374 |
| 5,158,022 | 10/1992 | Dugge et al. | 105/377.07 |
| 5,269,431 | 12/1993 | Sakata et al. | 220/374 X |
| 5,277,327 | 1/1994 | Nakano et al. | 220/374 X |
| 5,395,006 | 3/1995 | Verma | 220/371 |
| 5,517,925 | 5/1996 | Early | 105/377.07 |
| 5,622,117 | 4/1997 | Burian et al. | 220/378 X |
| 5,813,352 | 9/1998 | Bramlett et al. | 105/377.07 |

*Primary Examiner*—Stephen P. Garbe
*Assistant Examiner*—Robin A Hylton
*Attorney, Agent, or Firm*—Chase & Yakimo, L.C.

[57] ABSTRACT

A vented hatch cover for a container having an opening defining a hatch and a coaming on the container's exterior surrounding the hatch opening. The cover has an outer shell and an inner shell, each shell having a main body and a flanged portion. The bodies are sized to fit over and enclose the hatch opening. The flanged portions are bonded together and extend radially outwardly from the corresponding bodies to fixedly couple and hold the bodies of the inner and outer shells in a spaced relationship to present an air chamber therebetween. Balsa reinforcement members are spaced apart and fixed between the shells in a radial pattern within the air chamber to provide support to the cover without interfering with the air flow. Air inlets are formed through the flange and body of the inner shell to allow air flow from the container's exterior into the container via the air chamber. A sealing ring extends around the interior surface of the inner shell, preferably around the perimeter of the body thereof to contact and seal against the coaming.

9 Claims, 4 Drawing Sheets

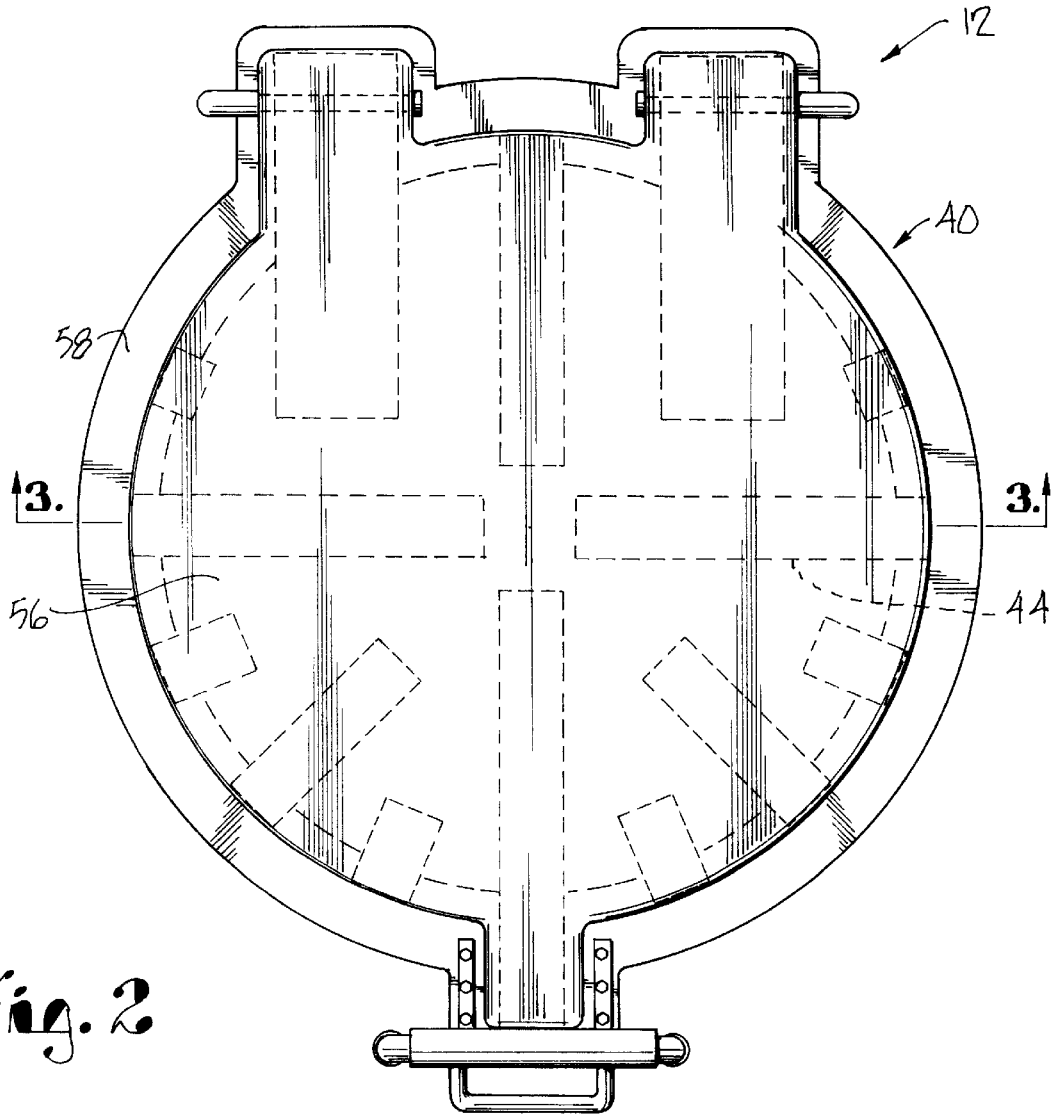
Fig. 2
Fig. 3
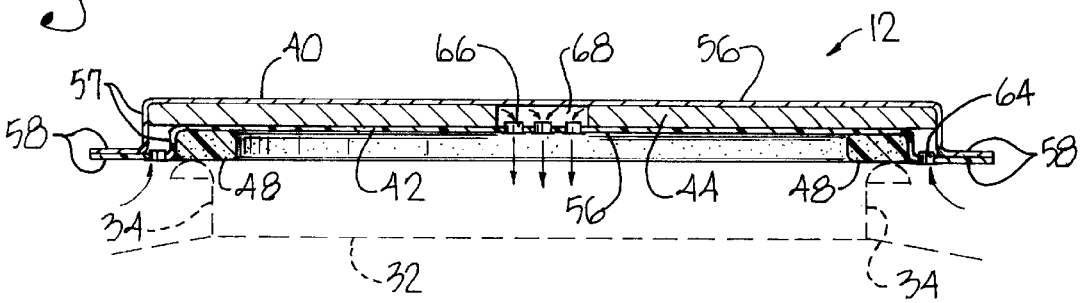

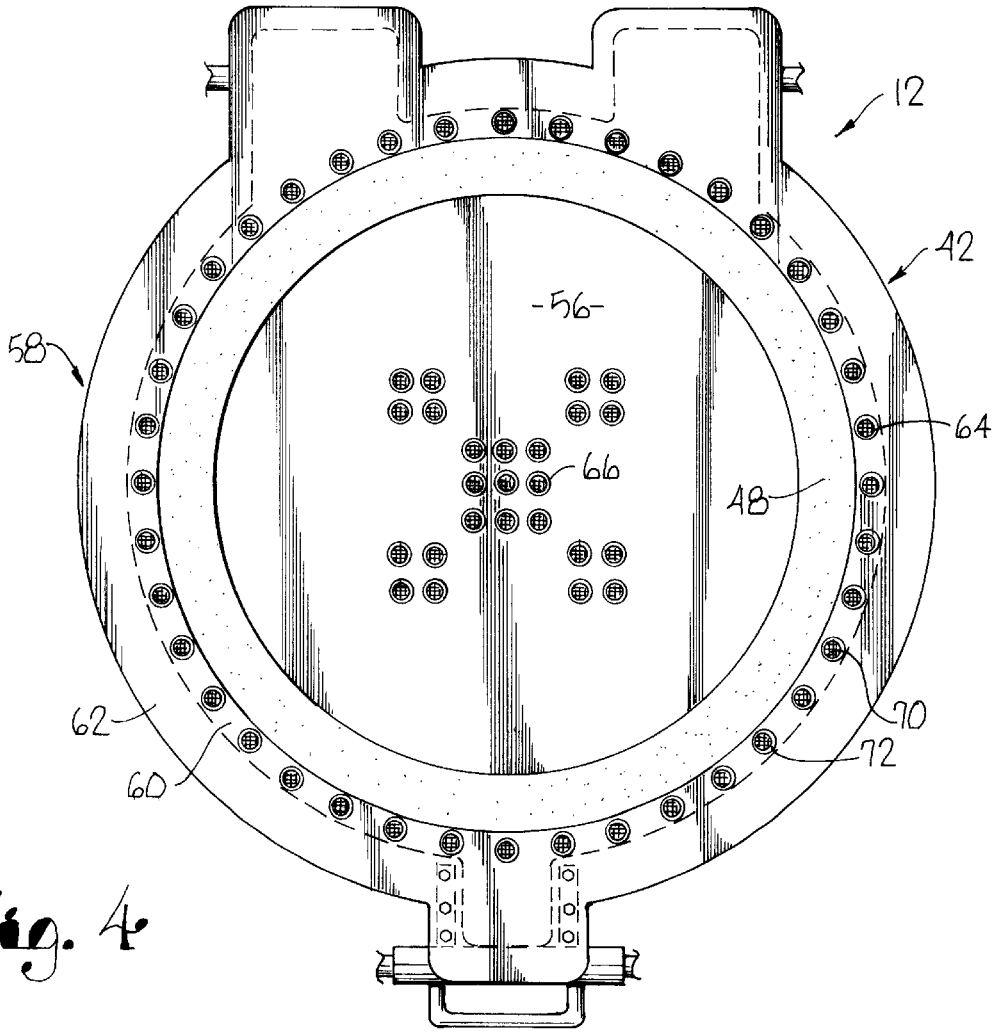
Fig. 4
Fig. 5
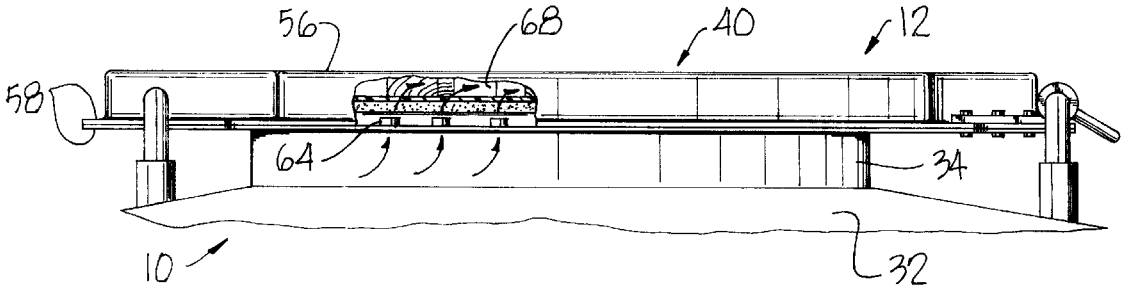

VENTED HATCH COVER

FIELD OF THE INVENTION

This invention relates to a vented hatch cover, especially for use with railroad hopper cars. More specifically, the hatch cover seals the railroad car's hatch from unwanted foreign material while allowing sufficient ventilation to compensate for lost volume as the car is emptied.

BACKGROUND OF THE INVENTION

Railroad hopper cars carrying bulk particulate matter, such as grain or plastic pellets, are typically unloaded by applying a vacuum conveying line to an outlet gate positioned at the bottom of each car compartment. The primary air flow for the vacuum conveying line is obtained from the exterior of the car. That is, the exhaust air for unloading is not drawn from the car compartment through the particulate matter. Nevertheless, the top of the car compartment must be vented to compensate for material drawn out the bottom of the compartment. Failure to vent the top of the compartment reduces the efficiency of the vacuum unloading process and even risks damage to the car's structure. Most commonly, venting for unloading hopper cars has been achieved by propping open at least one hatch cover on each hopper compartment being unloaded.

Opening hatch covers presents disadvantages. First, some means permitting safe access to the top of the railroad car must be provided. However, doing so, unduly complicates the unloading process. Secondly, open hatches tend to invite security problems. Not only is there a risk of contaminating the lading due to the open hatch, but also empty compartments are tempting disposal sites for refuse after the lading has been removed. Further, unless the hatch cover is secured by hinges and is lockable, the cover may be misplaced or stolen.

SUMMARY OF THE INVENTION

Accordingly, a primary object of the subject invention is to provide a vented hatch cover for railroad cars formed of two shells spaced apart to form a ventilating means therethrough.

Another object of the subject invention is to provide a vented hatch cover that does not require that it be removed or opened during unloading.

Another object of the subject invention is to provide a vented hatch cover that supplies sufficient venting to compensate for lost volume as the car is emptied and thus, prevent damage to the car structure.

Still another object of the subject invention is to provide a vented hatch cover that prevents the ingress of unwanted foreign material into the car.

These objects are attained by providing a vented hatch cover comprising a first outer shell and a second inner shell, each shell having a main body and a flanged portion. The bodies are sized to fit over and enclose the hatch opening. The flanged portions are bonded together and extend radially outwardly from the corresponding bodies to fixedly couple and thereby hold the bodies of the inner and outer shells in a spaced relationship to present an air chamber therebetween. Reinforcement members are spaced apart and fixed between the shells in a radial pattern within a portion of the air chamber to provide support to the cover without interfering with the air flow. Air inlets are formed through the flange and body of said inner shell to allow air flow from a cargo container's exterior into its interior via the air chamber. A sealing ring extends around the interior surface of the inner shell, preferably around the perimeter of the body thereof to contact and seal against the combing.

BRIEF DESCRIPTION OF THE DRAWINGS

FIG. 2 is a top plan view of a vented hatch cover of FIG. 1.

FIG. 3 is a sectional view of the hatch cover of FIG. 2 taken along line 3—3.

FIG. 4 is a bottom plan view of the vented hatch cover of FIG. 2.

FIG. 5 is a side elevational view of the vented hatch cover of FIG. 2 partially broken away to show the air flow therethrough.

DETAILED DESCRIPTION OF THE PREFERRED EMBODIMENT

Figure 1:
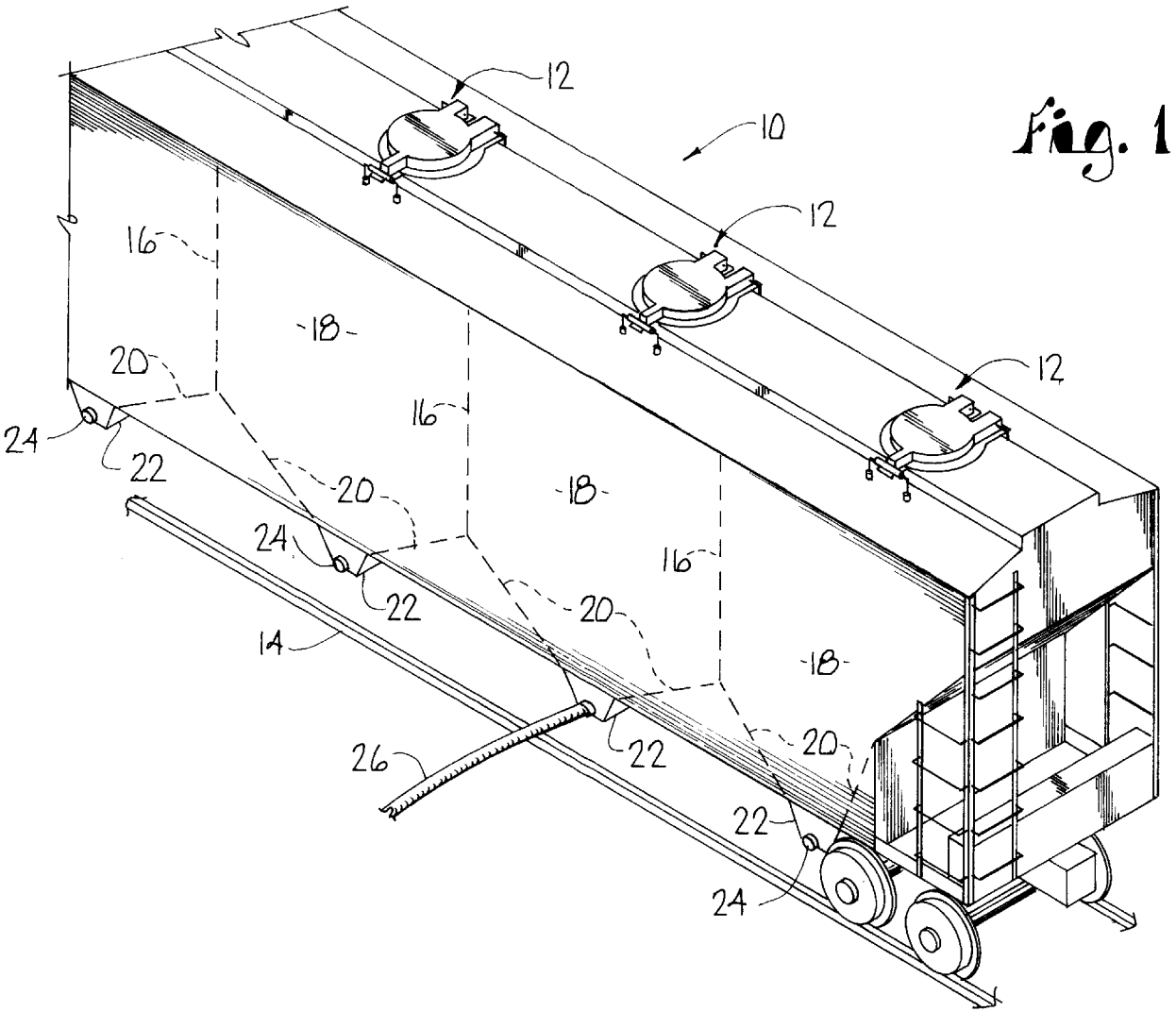
FIG. 1 is a perspective view of a portion of a covered railroad hopper car showing the vented hatch covers in accordance with the present invention thereon.

The vented hatch cover 12 of the present invention is illustrated in association with a covered railroad hopper car shown in FIG. 1 on railroad tracks 14. The hatch cover 12 is suitable for use in any vessel that requires venting, however. Car 10 is adapted to carry particulate fluent materials such as pallets, which are a raw material in the manufacture of various plastics. The interior of the car 10 has partitions 16 defining compartments or vessels 18. Each compartment 18 has a pair of slanted bottom walls 20 which direct particulate matter to an outlet gate 22 at the bottom of each compartment 18. Each outlet gate 22 has a duct 24 to which a vacuum conveying line 26 may be connected. The opposite side of the outlet gate 22 has an air inlet port (not shown) similar to duct 24, which admits the primary air supply for unloading purposes. Each hatch cover 12 provides sufficient venting for the associated compartment 18 during unloading to accommodate the change in volume resulting from movement of material from within the compartment.

Turning now to FIGS. 2–6, the vented hatch cover 12 is shown mounted on the exterior of car body 10. See especially FIG. 5. The hatch itself comprises an opening in the top 32 of the car 10. A hatch coaming 34 surrounds the opening.

The hatch cover 12 is generally a two piece design having an outer or exterior shell 40 formed of a suitable weather and impact resistant material, and an inner or interior shell 42 constructed of fiber glass or other suitable lightweight material. Interposed between the outer and inner shells 40 and 42 of the cover 12 are reinforcement or core members 44, preferably formed of balsa or other similar lightweight material, used to impart rigidity and strength to the cover structure. The cover 12 also includes a sealing member 48 to contact the coaming 34 of the hatch opening when the cover 12 is closed to seal the hatch opening from the elements, as in FIG. 3. The hatch cover 12 is secured and retained over coaming 34 by hinges 50 and lock 52, as in FIGS. 2, 4 and 6.

Both the outer and inner shells 40 and 42 of hatch cover 12 include a body portion 56 that is sized to extend over and beyond the hatch opening. The body 56, at its periphery, includes a rim 57 that extends or turns downwardly toward the car top 32 and then outwardly to present a circumferential lip or flange 58 around each shell 40 and 42. Flanges 58 extend radially outwardly from the periphery of body 56 and are fixedly bonded together so that shells 40 and 42 present an integral, unitary hatch cover 12. Also, flange 58 of inner shell 42 is wider or extends outwardly from the perimeter of inner shell 42 a greater distance than the flange 58 of outer shell 40 to present an inner portion 60 and an outer portion 62, as seen in FIG. 4. Shells 40 and 42 are coupled together adjacent the periphery of flanges 58 with the inner portion 60 of inner shell's flange 58 uncovered.

Shells 40 and 42 are attached in a spaced relationship. More specifically, the bodies 56 of shells 40 and 42 are spaced apart from one another. To achieve this spaced relationship, as seen in the Figures, body 56 of outer shell 40 has a larger diameter than that of inner shell 42. Rim 57 of outer shell 40 is also wider than that of inner shell 42 to space outer shell 40 above inner shell 42.

Figure 6:
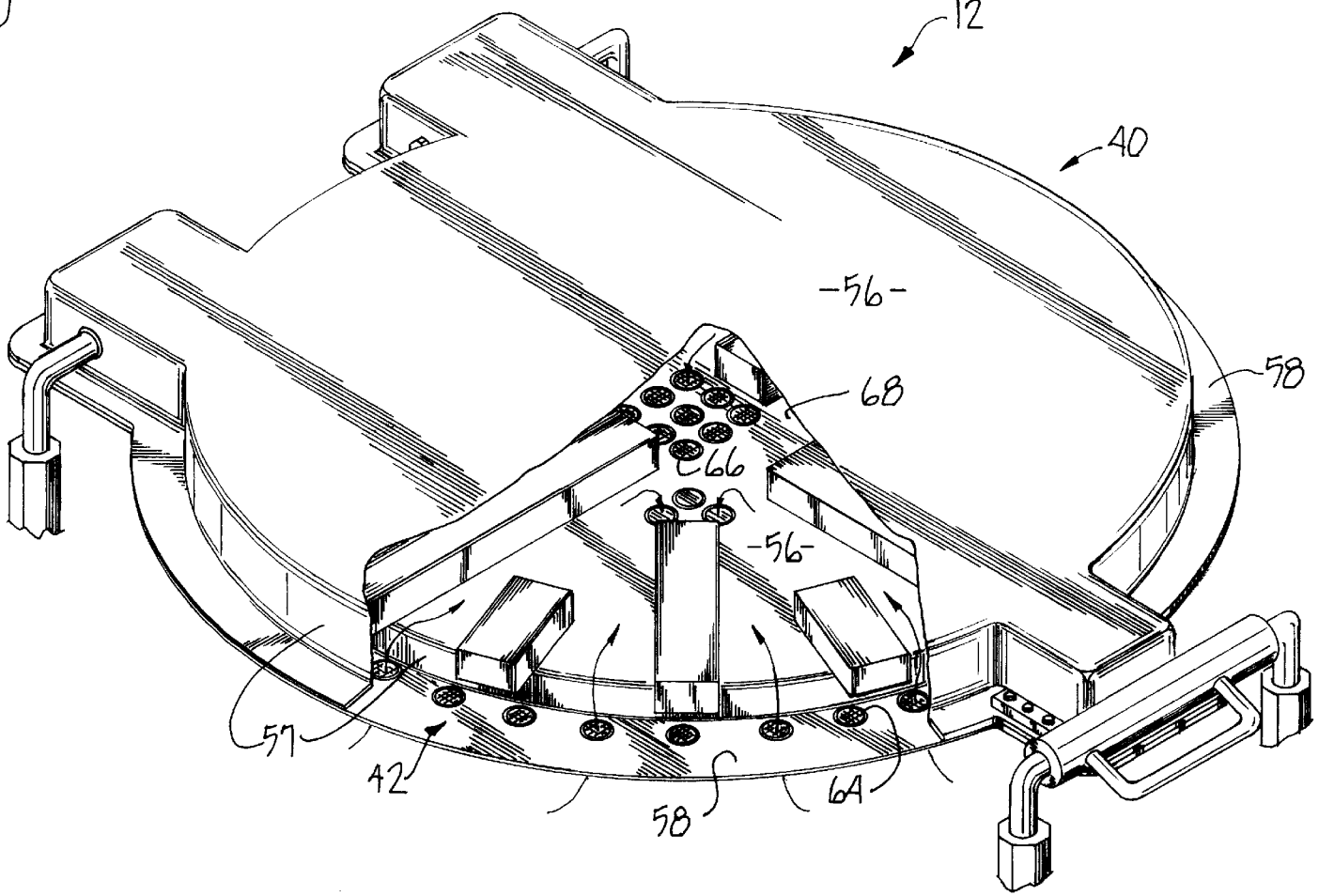
FIG. 6 is a perspective view of the vented hatch cover of FIG. 2 partially broken away to show the air flow therethrough.

Balsa reinforcement members 44 are radially disposed and fixedly secured to inner and outer shells 42 and 44 within the space therebetween so as to not interfere with the air flow therethrough, as best seen in FIGS. 2 and 6. Although other configurations may be used, balsa reinforcement members 44 as shown in FIG. 2 allow sufficient air flow therebetween while also providing sufficient support and rigidity to hatch cover 12 and maintaining its lightweight feature.

Air flow is provided through cover 12 by flange air inlets 64, body air inlets 66 and air passage 68, as best seen in FIG. 6. Flange air inlets 64 extend through the inner portion 60 of the inner shell's flange 58 and are spaced apart therearound. Body air inlets 66 extend through the center portion of the body 56 of inner shell 42, as in FIG. 4. Thus, air inlets 66 face downwardly toward car 10 and are covered by outer shell 40 to prevent the ingress of foreign materials into car 10. Air inlets 64 and 66 preferably include a wire mesh filter 70 mounted and secured therein by a grommet ring 72. Air passageway 68 is formed by the space presented between body portions 56 of outer and inner shells 40 and 42, as in FIGS. 3, 5 and 6.

Sealing member 48 is preferably a rubber ring which is fixedly mounted to the inner surface of inner shell's body 56 around its perimeter. Thus, sealing member 48 abuts the downwardly extending rim 57 of body portion 56 as in FIGS. 3 and 4. Sealing member 48, when in use, seals the hatch opening by snugly engaging and sealing coaming 34, as seen in FIG. 3.

In use, ventilation to a chamber 18 is provided as air enters flange air inlets 64, continues through air chamber or passageway 68 and into chamber 18 through body air inlets 66. This air flow path from the exterior or outside of hopper car 10 to the interior chambers thereof as illustrated by the arrows in FIGS. 3, 5 and 6.

Accordingly, each vented hatch cover 12 provides sufficient air flow and ventilation to the associated compartment 18 for efficient unloading of the material within each compartment 18 without risking damage to the railroad car's structure.

Having thus described the invention, what is claimed as new and desired to be secured by Letters Patent is as follows:

1. A vented hatch cover for a container having an opening defining a hatch, said cover comprising:

a first outer shell member and a second inner shell member sized to fit over and enclose a hatch opening and being bonded together in a spaced relationship at a flange structure extending outwardly from a periphery of said shell members;

said flange structure including an inner portion covered by said outer shell and an outer bonded portion;

air venting means formed in said cover for allowing air flow from a container's exterior into a container, said air venting means including at least one air inlet port in said inner portion of said flange structure, at least one air inlet port in said inner shell and an air chamber formed between said inner and outer shells;

reinforcement members spaced apart and fixedly mounted between said shells in a radial pattern to allow air flow therebetween.

2. A vented hatch cover as claimed in claim 1 further comprising a sealing ring mounted around said periphery of said inner shell member to seal the opening.

3. A vented hatch cover as claimed in claim 1 wherein a plurality of air inlet ports are spaced apart around said inner portion of said flange structure.

4. In combination with a railroad car having an opening defining a hatch, the improvement comprising:

a vented hatch cover including a first outer shell member and a second inner shell member, each member having a body portion and a flange portion, said body portions sized to fit over and enclose said hatch opening, said flange portions being bonded together and extending outwardly from corresponding body portions to fixedly couple said inner and outer shell portions together in a spaced relationship, air venting means formed in said cover for allowing air flow from said hatch's exterior into said hatch, and including air inlets through said inner shell member and an air chamber presented between said body portions of said shell members, at least one of said air inlets being through said flange of said inner shell member and at least one other air inlet being through said body portion of said inner shell member, to allow air flow from said hatch's exterior into said air inlet in said flange, through said air chamber and into said hatch, and sealing means on a surface of said inner shell member for sealing said hatch opening.

5. A vented hatch cover as claimed in claim 4, further comprising:

a reinforcement member fixed between said shell members to provide support to said cover.

6. A vented hatch cover as claimed in claim 4 wherein said air inlets are covered by said outer shell member to prevent the intake of foreign materials.

7. A vented hatch cover for a railroad car having an opening defining a hatch, said cover comprising:

a first outer shell member and a second inner shell member being fixedly coupled together in a spaced relationship at a periphery of each said shell member to present an air chamber therebetween, said shell members being sized to fit over and enclose a hatch opening and said inner shell member including a flange;

at least one air inlet through said flange communicating with said air chamber to allow air flow from a hatch's exterior into a hatch via said air chamber to facilitate the unloading of a railroad car, said outer shell member covering said flange to prevent intake of foreign material through said at least one air inlet; and sealing means on a surface of said inner shell member for sealing a hatch.

8. A vented hatch cover as claimed in claim 7, further comprising:

reinforcement members fixed between said shell members in a radial pattern and within a portion of said air chamber to provide support to said cover.

9. A vented hatch cover as claimed in claim 7 wherein said at least one air inlet has an air filter therein.

* * * * *